US008136913B2

(12) United States Patent
Yeh et al.

(10) Patent No.: US 8,136,913 B2
(45) Date of Patent: Mar. 20, 2012

(54) SYSTEM AND METHOD FOR MEASURING DROP POSITION IN AN IMAGE OF A TEST PATTERN ON AN IMAGE SUBSTRATE

(75) Inventors: Andrew S. Yeh, Portland, OR (US); Cary Eric Sjolander, Tigard, OR (US)

(73) Assignee: Xerox Corporation, Norwalk, CT (US)

( * ) Notice: Subject to any disclaimer, the term of this patent is extended or adjusted under 35 U.S.C. 154(b) by 476 days.

(21) Appl. No.: 12/408,151

(22) Filed: Mar. 20, 2009

(65) Prior Publication Data

US 2010/0238220 A1 Sep. 23, 2010

(51) Int. Cl.
*B41J 29/393* (2006.01)

(52) U.S. Cl. ..... 347/19; 347/5; 347/9; 347/12; 347/20

(58) Field of Classification Search ..... 347/19
See application file for complete search history.

(56) References Cited

U.S. PATENT DOCUMENTS

| | | | | |
|---|---|---|---|---|
| 4,751,517 | A | 6/1988 | Crean et al. | |
| 4,922,268 | A | 5/1990 | Osborne | |
| 6,257,143 | B1 | 7/2001 | Iwasaki et al. | |
| 6,290,320 | B1 | 9/2001 | Beauchamp et al. | |
| 6,331,038 | B1 | 12/2001 | Boleda et al. | |
| 6,454,390 | B1 | 9/2002 | Takahashi et al. | |
| 6,474,767 | B1 | 11/2002 | Teshigawara et al. | |
| 6,532,026 | B2 | 3/2003 | Takahashi et al. | |
| 6,575,548 | B1 | 6/2003 | Corrigan, III et al. | |
| 6,623,096 | B1 | 9/2003 | Castano et al. | |
| 6,755,499 | B2 | 6/2004 | Castano et al. | |
| 7,021,732 | B2 * | 4/2006 | Folkins | 347/8 |
| 2003/0020776 | A1 * | 1/2003 | Franzke et al. | 347/19 |
| 2004/0046820 | A1 | 3/2004 | Wu et al. | |
| 2005/0083364 | A1 | 4/2005 | Billow | |
| 2005/0248605 | A1 | 11/2005 | Pinard et al. | |
| 2006/0164454 | A1 | 7/2006 | Walmsley et al. | |
| 2007/0257969 | A1 | 11/2007 | Hawkins et al. | |
| 2008/0088657 | A1 | 4/2008 | Shinkawa et al. | |
| 2008/0122886 | A1 | 5/2008 | Snyder | |
| 2008/0225074 | A1 | 9/2008 | Van de Wynckel et al. | |
| 2009/0033957 | A1 | 2/2009 | Hardy | |
| 2009/0040261 | A1 * | 2/2009 | Zhang et al. | 347/19 |
| 2010/0013882 | A1 * | 1/2010 | Mizes et al. | 347/14 |
| 2010/0091334 | A1 * | 4/2010 | Qiao et al. | 358/3.26 |
| 2010/0135702 | A1 * | 6/2010 | Calamita et al. | 399/301 |
| 2010/0214344 | A1 * | 8/2010 | Sjolander et al. | 347/19 |
| 2010/0225691 | A1 * | 9/2010 | Wright et al. | 347/14 |
| 2010/0232652 | A1 * | 9/2010 | Yeh et al. | 382/112 |

* cited by examiner

*Primary Examiner* — Ryan Lepisto
(74) *Attorney, Agent, or Firm* — Maginot, Moore & Beck, LLP

(57) ABSTRACT

A system evaluates image quality in an image generating system in the presence of digital image noise and/or missing jets. The system includes a test pattern generator configured to generate a test pattern on an image substrate, an image capture device configured to generate a digital image of the generated test pattern on the image substrate, an image evaluator configured to process the digital image and generate a solution for an over-determined matrix of equations formed from differential distance measurements obtained with reference to a jet in the digital image by minimizing the root-mean-square (RMS) of residual errors corresponding to the matrix, and a controller configured to generate a correction parameter from the generated solution and to apply the correction parameter to the jet used for the used for the differential distance measurements.

18 Claims, 5 Drawing Sheets

SYSTEM AND METHOD FOR MEASURING DROP POSITION IN AN IMAGE OF A TEST PATTERN ON AN IMAGE SUBSTRATE

TECHNICAL FIELD

This disclosure relates generally to devices that generate images, and more particularly, for imaging devices that eject ink from inkjets to form an image.

BACKGROUND

Devices that generate images are ubiquitous in today's technology. These devices include inkjet ejecting devices, toner imaging devices, textile printing devices, circuit board printing devices, medical printing devices, monitors, cellular telephones, and digital cameras, to name a few. Throughout the life cycle of these devices, the image generating ability of the device requires evaluation and, if the images contain detectable errors, correction. Before such an imaging device leaves a manufacturing facility, the device should be calibrated to ensure that images are generated by the device without perceptible faults. As the device is used, the device and its environment may experience temperature instabilities, which may cause components of the device to expand and shift in relation to one another. As the device is used, the intrinsic performance of the device may change reversibly or irreversibly. Consequently, the imaging generating ability of such a device requires evaluation and adjustment to compensate for the changes experienced by the device during its life cycle. Sometimes these evaluations and adjustments are made at time or usage intervals, while at other times the adjustments are made during service calls made by trained technicians.

Drop placement in inkjet printers, including solid ink printers, may be imperfect from variations in drop direction, drop speed, drop travel distance, or the image substrate speed. These variations may produce objectionable artifacts in ink images. Additionally, components or subsystems of an imaging device experience aging during the operational life of the imaging device and the effects of this aging may produce variations that adversely affect image quality. Consequently, the ability to calibrate and adjust components and subsystems in an imaging system in both the manufacturing and operational environment is important.

In order to calibrate inkjet imaging systems, test patterns are printed and imaged. Typically, the test patterns are printed onto image substrates, such as media sheets, either directly or indirectly, and the substrate is imaged using a scanner or the like. The image is then analyzed to determine the actual position of the ink drops ejected to form the image and these positions are compared to internal representations of the test pattern to detect discrepancies between the actual positions of the drops and the intended positions of the pixels. This analysis is complicated by image noise and/or missing drops. For example, some imaging systems print the test pattern onto a rotating image member, the test pattern is then transferred to a media sheet, and the media sheet is imaged for analysis. The rotating image member may be an anodized aluminum drum. Scratches in the drum finish may obscure drops in the image and be a source of image noise. Missing jets are inkjets that either do not eject drops when they receive firing signals to eject ink or respond to those signals in an intermittent manner. Image analysis that is able to successfully identify drop positions in an image in the presence of image noise and/or missing drops is, therefore, desirable.

SUMMARY

A system evaluates image quality in an image generating system in a manner that is robust in the presence of image noise and/or missing jets. The system includes a test pattern generator configured to generate a test pattern on an image substrate, an image capture device configured to generate a digital image of the generated test pattern on the image substrate, and an image evaluator configured to process the digital image and generate a solution for an over-determined matrix of equations formed from differential distance measurements obtained with reference to a jet in the digital image, and a controller configured to generate a correction parameter from the generated solution and to apply the correction parameter to the jet used for the differential distance measurements.

A method evaluates image quality in an image generating system in a manner that is robust in the presence of image noise and/or missing jets. The method includes generating a test pattern on an image substrate, generating a digital image of the test pattern on the image substrate, generating a plurality of differential distance measurements between an ink drop in the digital image that was ejected from a first jet and a plurality of ink drops in the digital image that were ejected from other jets, forming an over-determined matrix of equations with the plurality of differential distance measurements, generating a solution of the over-determined matrix by minimizing the root-mean-square (RMS) of residual errors corresponding to the matrix, generating a correction parameter with reference to the solution of the over-determined matrix, and applying the correction parameter to an imaging system component to adjust a position of an ink drop ejected by the first jet.

BRIEF DESCRIPTION OF THE DRAWINGS

The foregoing aspects and other features of a system that identifies drop positions in the presence of image noise and/or missing drops are explained in the following description, taken in connection with the accompanying drawings.

DETAILED DESCRIPTION

Figure 1:
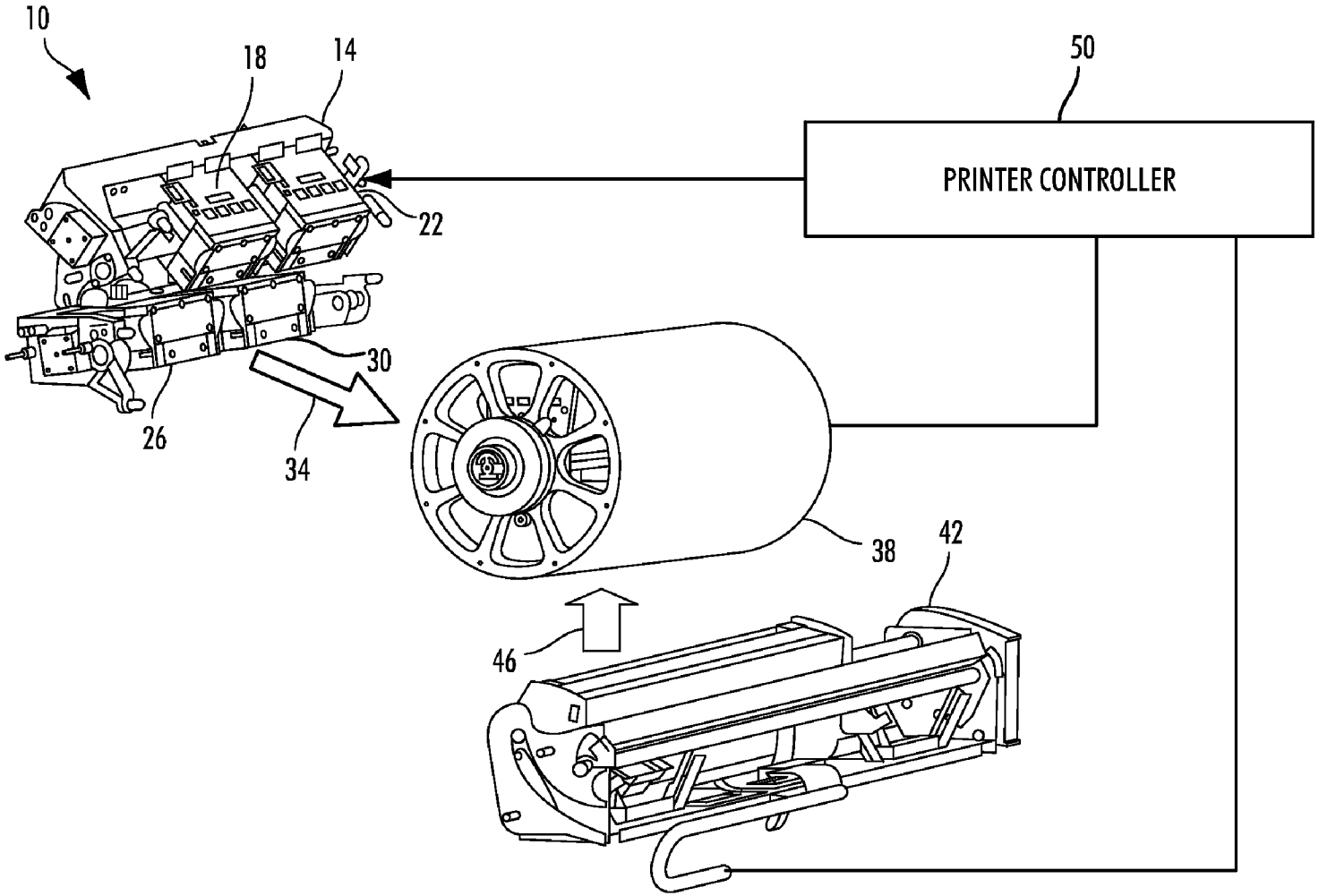
FIG. 1 is a block diagram of a printer depicting the components operated by a controller to identify ink drop positions in a test pattern image.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multifunction machine, textile printer, circuit board printer, or the like. Also, the description presented below is directed to a system for operating an inkjet printer to print test patterns on an image substrate and to analyze digital images of the test patterns. The reader should also appreciate that the principles set forth in this description are applicable to similar test pattern generators and digital image analyzers that may adapted for use in any imaging device that generates images with dots of marking material.

As shown in FIG. 1, a particular image generating system may be a printer. The printer 10 includes a printhead assembly 14, a rotating intermediate imaging member 38, an image capture device 42, such as a scanner, and a printer controller 50. The printhead assembly 14 includes four printheads 18, 22, 26, and 30. Typically, each of these printheads ejects ink, indicated by arrow 34, to form an image on the imaging member 38. The four printheads are arranged in a two by two matrix with the printheads in one row being staggered with reference to the printheads in the other row. Controlled firing of the inkjets in the printheads in synchronization with the rotation of the imaging member 38 enables the formation of a single continuous horizontal bar across the length of the imaging member. The intermediate imaging member 38 may be a rotating drum, as shown in the figure, belt, or other substrate for receiving ink ejected from the printheads. Alternatively, the printheads may eject ink onto a substrate of media moving along a path adjacent to the printheads. The image capture device 42 includes a light source for illuminating the imaging member 38 and a set of electro-optical sensors, each of which generates an electrical signal having an amplitude that corresponds to the intensity of the reflected light received by a sensor.

The printer controller 50 includes memory storage for data and programmed instructions. The controller may be implemented with general or specialized programmable processors that execute programmed instructions. The instructions and data required to perform the programmed functions may be stored in memory associated with the processors or controllers. The processors, their memories, and interface circuitry configure the controllers to perform the functions, such as the test pattern generation and the digital image analysis, described more fully below. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

The controller 50 in FIG. 1 is coupled to the printhead assembly 14, the imaging member 38, and the scanner 42 to synchronize the operation of these subsystems. To generate an image, the controller renders a digital image in a memory and generates inkjet firing signals from the digital image. The firing signals are delivered to the printheads in the assembly 14 to cause the inkjets to eject ink selectively. The controller is also coupled to the imaging member 38 to control the rate and direction of rotation of the imaging member 38. Controller 50 also generates signals to activate the scanner for illumination of the imaging member 38 and generation of a digital image that corresponds to the image on the member 38. The digital image is received by the controller 50 for storage and processing.

To evaluate the quality of the images being generated in one embodiment, the controller 50 may execute programmed instructions that enable the printer to implement a plurality of processes for generating image quality adjustments. In general, these processes result in the generation of ink images, called test patterns, on the imaging member 38, and the processing of the digital images generated by the scanner 42 from the image on the drum. Although the description below is directed to a system in which the electro-optical sensor(s) used to image the test pattern on a rotating image member are integrated within the imaging system, the image may be generated by a scanner integrated in the image generating system or by a standalone scanner. These scanners may obtain a digital image from a media sheet on which the test pattern has been directly printed or to which the test pattern has been transferred from a rotating image member. The image data generated by the standalone scanner may be transmitted to a data connection of the imaging system for receipt and storage of the image in the system or the image may be stored on storage media and read by the imaging system for analysis. The processing of the scanned test pattern image enables the generation of positional coordinates for drops ejected by each inkjet.

In the system and method discussed below, a test pattern may be printed, imaged, and analyzed to obtain measurements from the positions of ink drops ejected from each jet. The positions of the drops ejected from the ink jets are then corrected with reference to the measurements. Additionally, a test pattern may be printed and imaged multiple times to increase signal to noise ratios in the scanned images. These multiple instances of a test pattern may be evenly spaced or otherwise made to span the surface of a rotating image member. This separation helps minimize run-out positional inaccuracy. Test patterns may also comprise absolute or differential distance measurement. Differential measurements are made between drops ejected by different jets. Additionally, two differential distance test patterns may be placed together with reflection symmetry to produce a larger test pattern. Differential test patterns and test patterns with reflection symmetry reduce measurement inaccuracies caused by different sources of noise and imperfection.

Figure 3:
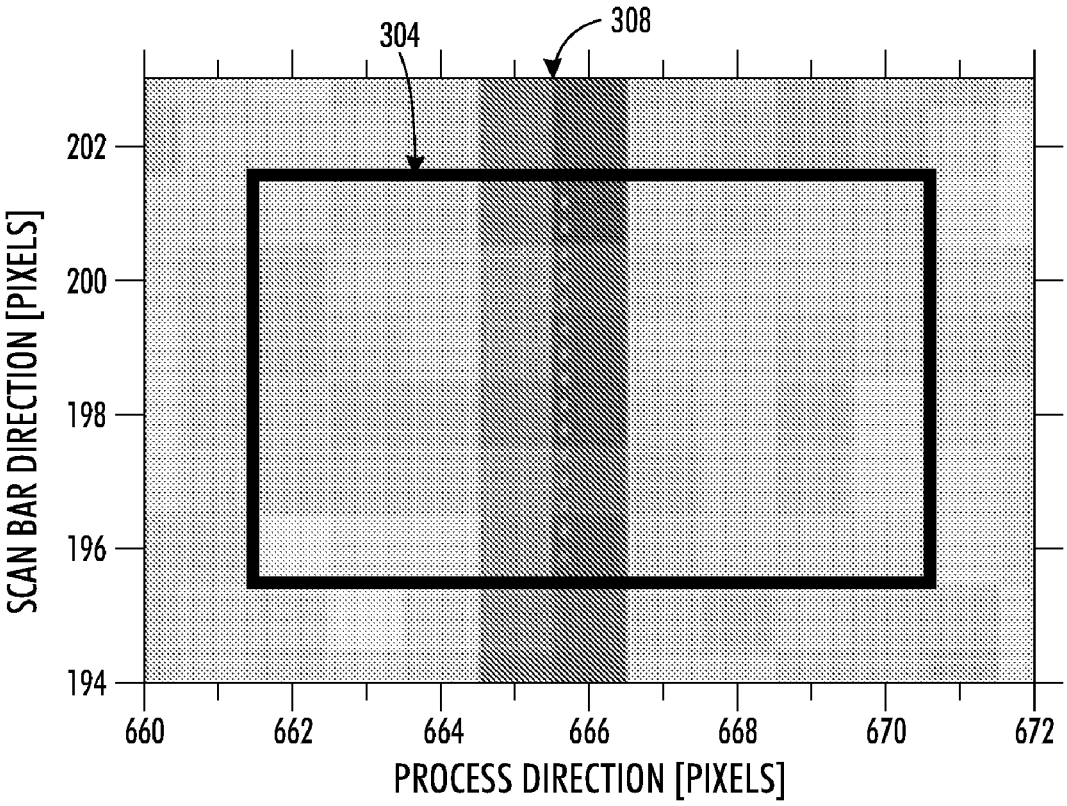
FIG. 3 is a portion of a digital image of a single line segment within a test pattern.
Figure 4:
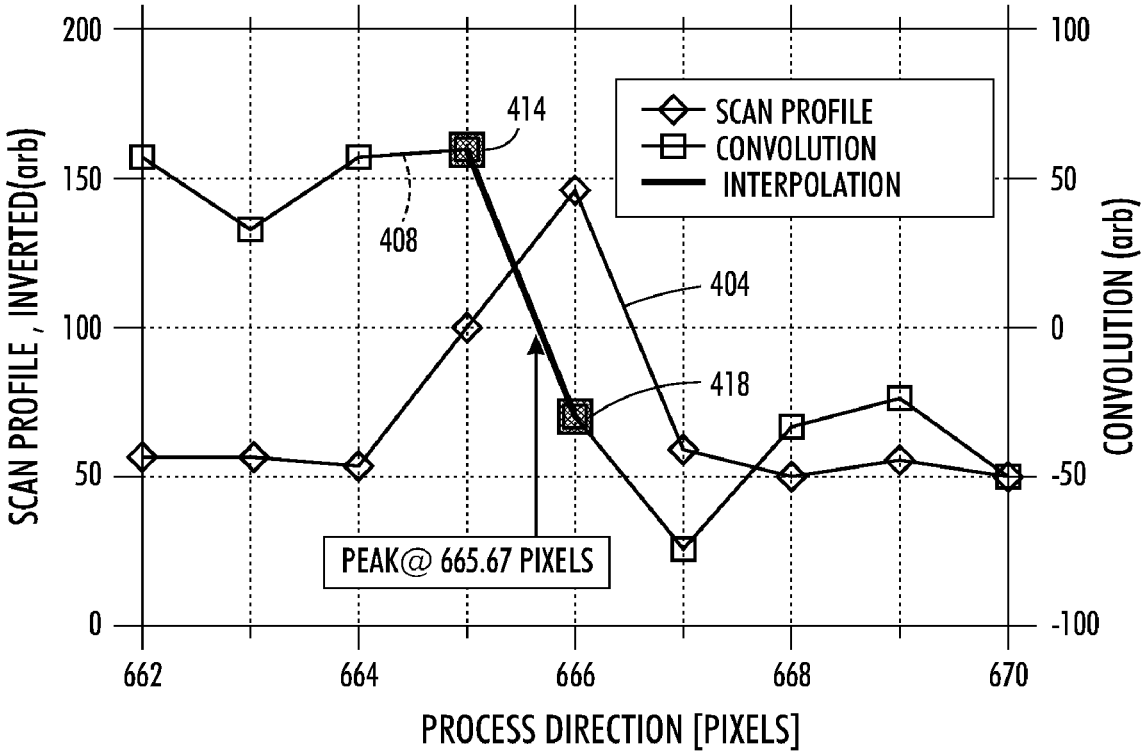
FIG. 4 is a graph of the profile of the image data shown in FIG. 3 and of a convolution of the profile and a derivative of a Gaussian function to identify a position of the line in FIG. 3.

A process for identifying a line in a digital image of a test pattern is now described with reference to FIG. 3 and FIG. 4. After a test pattern has been printed on an image receiving member, the test pattern is imaged. A portion 300 of the digital image of a line in a test pattern is shown in FIG. 3. A region of interest 304 is analyzed by a process that identifies the location of the line. The reader should note that the line in the test pattern is oriented in the cross-process direction as the process direction pixels are located along the bottom axis of FIG. 3 while the pixels in the cross-process direction are located along the vertical axis. The boundary for the region of interest is identified by a process that identifies fiducial patterns on other areas of the image substrate and develops a coordinate transformation that correlates pixel positions in an internal representation of the test pattern with the test pattern image. The vertical dark portion 308 of the image corresponds to a line whose position is to be identified. As can be discerned from the image, the region of interest nine pixels wide and six pixels high. The pixel values of each vertical column are added, averaged, and inverted to produce the scan profile shown 404 in FIG. 4.

To identify the position of the line in FIG. 3, the profile is convolved with a derivative of a Gaussian function. Line 404 depicts the profile in FIG. 4, while line 408 depicts the convolution in the same figure. The derivative of Gaussian function filters the profile to smooth noise in the profile and to convert the peak to a zero crossing function. The parameters of the derivative of Gaussian function are determined by design of experiments for optimal repeatability and best fit. The position of the line is identified by interpolating the pixel position corresponding to the zero crossing between the two points 414 and 418 spanning the zero crossing. This position is process direction pixel position 665.67. The absolute process direction position for any drop ejected from an inkjet may be identified in this manner. Additionally, a differential distance measurement between two jets may be obtained from the difference between absolute position measurements of two jets positioned near one another, the measurements being obtained at about the same time. Differential measurements are more precise than absolute distance measurements, as they limit the effect of environmental, electro-optical, mechanical, thermal, or other factors, which vary in location or time. For example, differential measurements that are perpendicular to the orientation of the electro-optical sensor help eliminate offsets caused by mis-registration of sensor elements. Additionally, two differential distance measurements may be combined to form a larger test pattern with reflection symmetry. For example, in FIG. 2, the test pattern 220 consists of four line segments produced by the two jets. The line segments 201 are produced by the first jet, and the line segments 202 are produced by the second jet. The line segments have reflection symmetry across a vertical axis of symmetry; specifically, note that on the left half of pattern 220, line segment 202 is immediately to the left of line segment 201, whereas on the right half of pattern 220, line segment 202 is immediately to the right of line segment 201. Test patterns with reflection symmetry nullify the linear component of environmental, electro-optical, mechanical, thermal, or other factors, which vary in location and with time. For example, if the substrate speed is linearly increasing instead of constant, the test pattern 220 is insensitive to the substrate motion artifact. To convert the differential distance measurements to the optimal solution for absolute jet positions, a matrix of linear equations is constructed from the test pattern measurements. The solution, which minimizes the root-mean-square (RMS) or the Euclidean norm of the residual errors, may be obtained by singular value decomposition of the matrix.

Corrections for drop placements that produce unacceptable anomalies may be addressed by calculating a target curve. For example, this target curve may be calculated by smoothing the positional data obtained from the process described above over an experimentally determined length scale that is dependent upon human eye perception of line and text quality. Adjustments that may be made to move a drop from its identified position to one closer to the target curve include adjustment of firing signal amplitude, firing signal timing, input image bit map, or mechanical adjustments of printheads or the like.

A method of computing the best solution in the presence of missing ink drops is now discussed. In brief, the process determines whether drops from all of the inkjets are present in the region of interest. If they are, the optimal solution is obtained by minimizing the root-mean-square (RMS) of the residual errors. If ink drops are missing, the matrix of linear equations is modified in response to the lack of information from incomplete test patterns. If too little information remains, the resultant matrix may be ill-conditioned or singular, resulting in a less accurate solution. To decrease the chances of an ill-conditioned or singular matrix, a test pattern has been developed with over-determination. A necessary, though not sufficient condition, for over-determination is that $P>J+1$ should be obtained, with J jets and P jet pair measurements. When M measurements are corrupt, the condition changes to $P>M+J+1$. To satisfy both of these conditions, a test pattern with $(P-J)$ much larger than the likely number of missing measurements should be chosen. In one embodiment, $P=1537$ and $J=880$. In addition, the jet pair measurements are selected to be between jets in the same color and between jets in different colors to provide as much information as possible. For example, the nth black pixel may be denoted as black(n). Five jet pair measurements may be obtained with the following measurements: black(n)−(black(n−1), black(n+1)−black(n), cyan(n)−black(n), magenta(n)−black(n), and yellow(n)−black(n). An optimal solution, which minimizes the RMS of the residual errors, may be obtained by singular value decomposition as applied to well-conditioned, ill-conditioned, or singular matrices, as necessary. This method may be used to compute the positions of an arbitrary number of inkjets, colors, and printheads simultaneously using the same coordinates. Also, as set forth below, a computationally faster iterative method may be used to approximate a solution more quickly.

Figure 2:
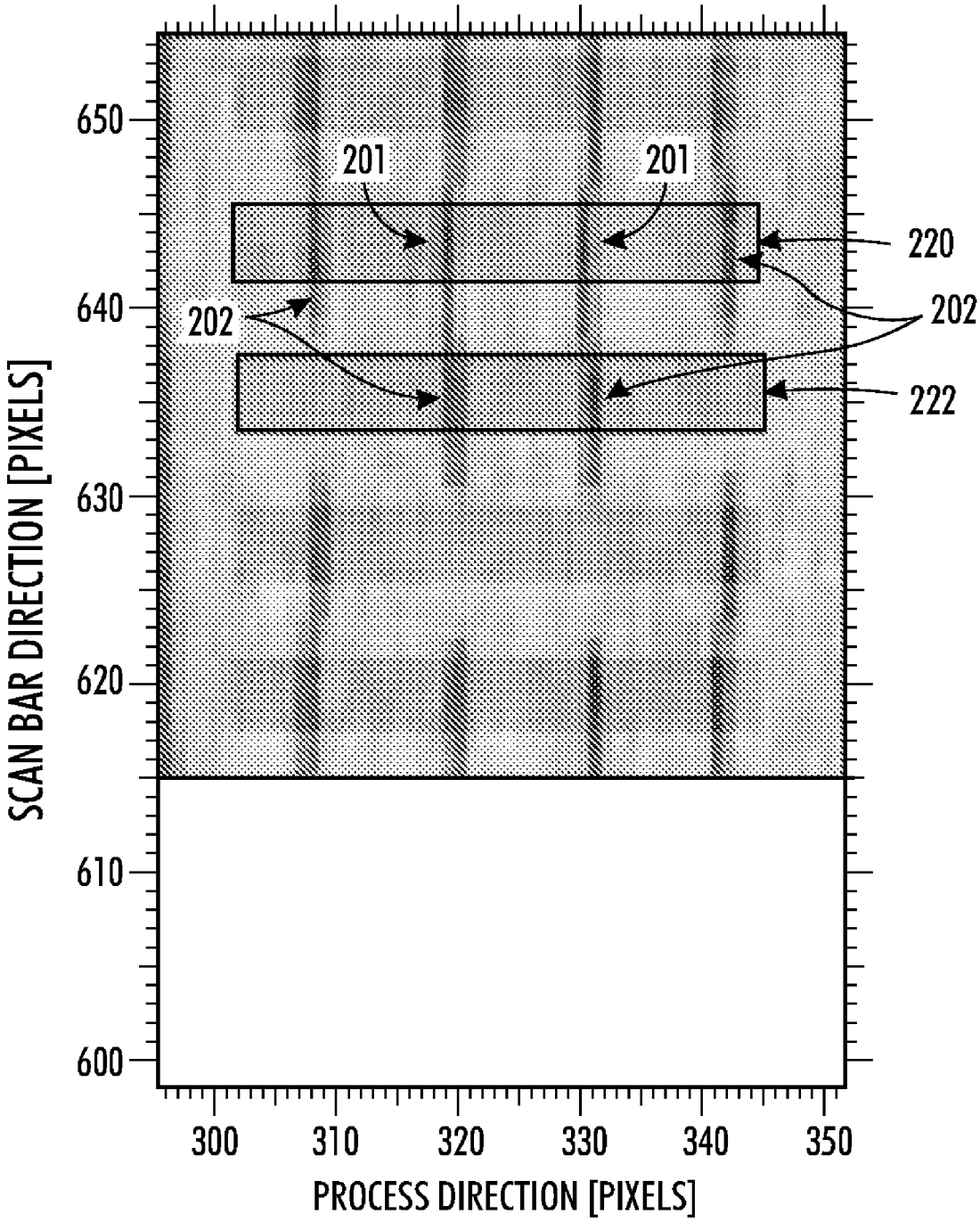
FIG. 2 is a portion of a digital image of a test pattern in the presence of image noise and missing ink drops.

An example of a test pattern with missing drops is shown in test pattern 222 in FIG. 2. Two line segments 202 are present, and two line segments, one on the far left and the other on the far right of the test pattern, are missing. Missing drops may be detected through tests on multiple metrics, such as the number of lines detected, the spacing between lines produced by the same jet, and the range of the convolution function. For example, the process described above would fail to find enough lines in test pattern 222. In order to detect missing jets, test patterns with redundant test blocks are printed. The redundant test patterns enable missing drops to be detected. Isolated instances of corruption due to imaging member scratches and the like may be distinguished from multiple occurrences of missing jets.

If missing jets or test patterns are detected, a solution with minimal RMS in the jet positions from the infinite number of solutions with optimal RMS of the residual errors may also be obtained by using the singular value decomposition of the matrix in a known manner. The use of the singular value decomposition, while highly accurate, consumes a significant amount of time. Furthermore, a new computation is necessary for every permutation of missing jets or test patterns. To shorten the computation time, an iterative method is used that successively approximates the solution by using information that the missing jets or test patterns affect only a small number of jet pair measurements. First, the singular value decomposition is calculated on the matrix corresponding to the test pattern with all jets present. This time consuming computation is performed in advance and stored in memory. When missing test patterns are detected, the matrix corresponding to the test pattern with all information present is slightly discrepant. This matrix is used to compute very quickly a solution that is also slightly discrepant. The discrepant solution is substituted into the correct matrix of equations, which include the missing test patterns, and the differences against the measured line position are determined. The differences are combined with the discrepant singular value decomposition to generate an improved solution, and this iterative improvement process continues until the solutions converge. The benefit of the iterative process for obtaining the solution is in a reduction in computational time. The number of computations is reduced by a power of ⅔ over the singular value decomposition method.

Figure 5:
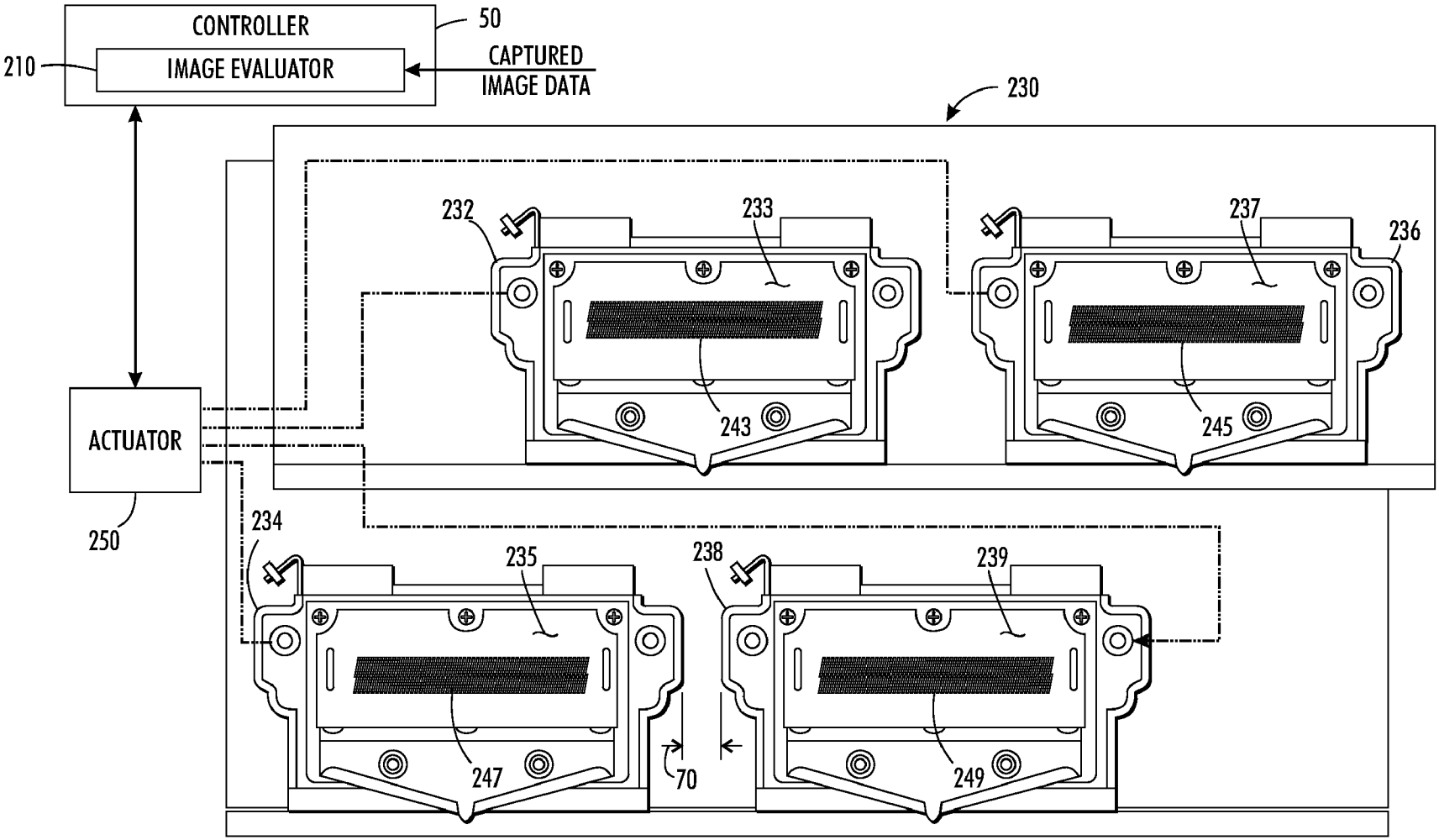
FIG. 5 is a block diagram of a system that identifies ink drop positions, generates correction parameters, and applies the correction parameters to printer components.

Referring now to FIG. 5, a SFWA printhead assembly for a high-speed, or high throughput, multicolor image producing machine is shown. The assembly 230 is coupled to the controller 50 and at least one actuator 250. The assembly 230 has four printheads 232, 234, 236, and 238. The upper printheads 232 and 236 and lower printheads 234 and 238 are arranged in a staggered pattern. Each printhead 232, 234, 236, and 238 has a corresponding front face 233, 235, 237 and 239 for ejecting ink onto an image receiving member to form an image. The staggered arrangement enables the printheads to form an image across the full width of the substrate. In print mode the printhead front faces 233, 235, 237, 239 are disposed close, for example, about 23 mils, to the imaging surface 14 of the drum 12. In one embodiment, each printhead is approximately 2.5 inches long. This length enables the SFWA printhead assembly to print an image that is approximately 10 inches long in the cross-process direction. Each printhead may be coupled to an actuator 250. The actuator is coupled to the printheads through gear trains, translational, or rotational linkages to move the printheads. The actuators 250 respond to signals from the controller 50. A portion of the instructions executed by the controller 50 implement an image evaluator 210 that processes captured image data of test patterns to locate the positions of the jets as described above. The controller 50 generates correction parameters from these positions and applies them to printer components. In one application of the correction parameters, other processes implemented by the controller 50 convert the correction parameters to stepper motor pulses or other control signals for activating the actuators 250 to move the positioning of the printheads 232, 234, 236, and 238. Other processes may apply the correction parameters by adjusting firing signal parameters for a jet from which the differential distance measurements were made. Other processes may adjust values in the image bit map stored in a memory coupled to the controller 50.

The ejecting face of each printhead 232, 234, 236, and 238 includes a plurality of nozzles 243, 247, 245, 249, respectively, that may be arranged in rows that extend in the cross-process direction (X axis) across the ejecting face. The spacing between each nozzle in a row is limited by the number of ink jets that can be placed in a given area in the printhead. To enable the printing of drops onto a receiving substrate at distances that are closer in the cross-process direction than the distance between adjacent nozzles in a row, the nozzles in one row of a printhead are offset in the cross-process direction (along the X axis) from the nozzles in at least some of the other rows in the printhead. The offset between nozzles in adjacent rows enables the number of ink drops in a printed row to be increased by actuating the inkjets in a subsequent row to eject ink as the drops ejected by a previous row arrive. Of course, other arrangements of nozzles are possible. For example, instead of having offset rows of nozzles, the nozzles may be arranged in a grid in the ejecting face with linear rows and columns of nozzles. Each printhead in an assembly may be configured to emit ink drops of each color utilized in the imaging device. In such a configuration, each printhead may include one or more rows of nozzles for each color of ink used in the imaging device. In another embodiment, each printhead may be configured to utilize one color of ink so the jets of the printhead eject the same color of ink.

In operation, the controller of an imaging system is configured with programmed instructions to print test patterns for addressing run-out inaccuracies and to detect missing jets. The instructions also enable the controller to analyze the images of the test patterns to generate jet position measurements that form an over-determined matrix of equations. The matrix is solved to minimize the RMS of residual errors if no jets are missing. Otherwise, the matrix is solved to minimize the RMS of jet position errors from the infinite number of solutions with optimal RMS of the residual errors. In one embodiment, singular value decomposition of the matrix is used to identify a solution. In another embodiment, an iterative method that successively approximates the solution using the information that the missing jets only affect a small number of jet pair measurements. During the life of the imaging system, the controller generates and images test patterns for analysis and generation of correction data in accordance with a schedule or in response to manual activation by a user or a customer service technician.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A system for evaluating image quality in an image generating system comprising:

a test pattern generator configured to generate a test pattern on an image substrate;

an image capture device configured to generate a digital image of the generated test pattern on the image substrate;

an image evaluator configured to process the digital image, to detect missing jets from the digital image, and to generate a solution for an over-determined matrix of equations formed from differential distance measurements obtained with reference to a jet in the digital image by minimizing the root-mean-square (RMS) of residual errors corresponding to the matrix; and a controller configured to generate a correction parameter from the generated solution and to apply the correction parameter to the jet used for the differential distance measurements.

2. The system of claim 1 wherein the test pattern generator generates multiple copies of the test pattern on the image substrate.

3. The system of claim 2 wherein the test pattern generator generates the multiple copies of the test pattern on the image substrate about a surface of the image substrate.

4. The system of claim 1, the test pattern generator generates a first test pattern and a second test pattern on the image substrate, the second test pattern having reflection symmetry with reference to the first test pattern.

5. The system of claim 1, the image evaluator being configured to generate a solution to the over-determined matrix of equations by singular value decomposition.

6. The system of claim 1 wherein the image evaluator is configured to generate a solution for the matrix of over-determined equations using at least one of singular value decomposition and iterative improvement of solutions to the matrix.

7. The system of claim 1, the controller being configured to apply the correction parameter by adjusting an image bit map stored in a memory coupled to the controller.

8. The system of claim 1, the controller being configured to apply the correction parameter by adjusting firing signal parameters for the jet used for the differential distance measurements.

9. The system of claim 1, the controller being configured to apply the correction parameter by mechanically adjusting a position of a printhead in which the jet used for the differential distance measurements is located.

10. A method for evaluating image quality in an image generating system comprising:

generating a test pattern on an image substrate;

generating a digital image of the test pattern on the image substrate;

generating a plurality of differential distance measurements between an ink drop in the digital image that was ejected from a first jet and a plurality of ink drops in the digital image that were ejected from other jets;

detecting missing jets from the differential distance measurements;

forming an over-determined matrix of equations with the plurality of differential distance measurements;

generating a solution of the over-determined matrix by minimizing the root-mean-square (RMS) of residual errors corresponding to the matrix;

generating a correction parameter with reference to the solution of the over-determined matrix; and applying the correction parameter to an imaging system component to adjust a position of an ink drop ejected by the first jet.

11. The method of claim 10, the test pattern generation further comprising:

generating multiple copies of the test pattern on the image substrate; and generating a digital image of the multiple copies of the test pattern on the image substrate.

12. The method of claim 11, the generation of the multiple copies further comprising:

positioning the multiple copies of the test pattern about a surface of the image substrate.

13. The method of claim 10, the generation of the test pattern further comprising:

generating a first test pattern and a second test pattern on the image substrate, the second test pattern having reflection symmetry with reference to the first test pattern.

14. The method of claim 10, the solution generation further comprising:

generating a solution with singular value decomposition of the over-determined matrix.

15. The method of claim 10, the solution generation further comprising:

solving the over-determined matrix by one of singular value decomposition and iteratively improving solutions to the over-determined matrix.

16. The method of claim 10, the application of the correction parameter further comprising:

adjusting an image bit map stored in a memory of the image generating device.

17. The method of claim 10, the application of the correction parameter further comprising:

adjusting a firing signal parameter for the first jet used for the differential distance measurements.

18. The method of claim 10, the application of the correction parameter further comprising:

mechanically adjusting a position of a printhead in the image generating device.

* * * * *